US008517060B2

(12) United States Patent
Champion et al.

(10) Patent No.: US 8,517,060 B2
(45) Date of Patent: Aug. 27, 2013

(54) LOOM AND A METHOD OF CONTROLLING THE TEMPERATURE OF A LUBRICANT IN SUCH A LOOM

(75) Inventors: Clement Champion, Cran Gevrier (FR); Sebastien Communal, Duingt (FR)

(73) Assignee: Staubli Faverges, Faverges (FR)

( * ) Notice: Subject to any disclaimer, the term of this patent is extended or adjusted under 35 U.S.C. 154(b) by 114 days.

(21) Appl. No.: 13/183,673

(22) Filed: Jul. 15, 2011

(65) Prior Publication Data

US 2012/0012223 A1 Jan. 19, 2012

(30) Foreign Application Priority Data

Jul. 19, 2010 (FR) ..... 10 55846

(51) Int. Cl.
*D03J 1/00* (2006.01)
*D03D 49/00* (2006.01)

(52) U.S. Cl.
USPC ..... 139/36; 139/1 R; 139/1 C

(58) Field of Classification Search
None
See application file for complete search history.

(56) References Cited

U.S. PATENT DOCUMENTS 2,131,706 A * 9/1938 Joyce et al. ..... 139/1 D
2,714,371 A * 8/1955 Porter ..... 91/167 R
3,395,432 A * 8/1968 Hasler et al. ..... 112/80.71
3,971,418 A * 7/1976 Fowler ..... 139/116.6
4,188,980 A * 2/1980 Muller ..... 139/1 R
4,444,292 A * 4/1984 Brown et al. ..... 184/6
4,895,192 A * 1/1990 Mortenson ..... 141/5
4,913,181 A * 4/1990 Mortenson ..... 137/12
5,172,732 A * 12/1992 Krumm et al. ..... 139/1 E
5,213,700 A * 5/1993 Smith ..... 508/580
5,647,402 A * 7/1997 Palau et al. ..... 139/1 R
5,696,061 A * 12/1997 Walsh ..... 508/268
6,247,503 B1 * 6/2001 Shaw et al. ..... 139/1 E
6,265,039 B1 * 7/2001 Drinkwater et al. ..... 428/36.1
6,491,068 B1 * 12/2002 Markward et al. ..... 139/1 R
6,820,655 B2 * 11/2004 Beeh ..... 139/1 C
7,310,565 B2 * 12/2007 Vergote et al. ..... 700/140
2003/0178089 A1 * 9/2003 Beeh ..... 139/453
2004/0133297 A1 * 7/2004 Vergote et al. ..... 700/140

FOREIGN PATENT DOCUMENTS

JP 10 251943 A 9/1998
JP 2004 100095 A 4/2004

* cited by examiner

*Primary Examiner* — Bobby Muromoto, Jr.
(74) *Attorney, Agent, or Firm* — Dowell & Dowell, P.C.

(57) ABSTRACT

A loom having a subassembly including heddles, a beater, and a device for inserting weft into a shed formed by warp yarns and also including a shed-forming device and a lubrication system for lubricating certain components of the subassembly including a first circuit for circulating a first lubricant and a second circuit for circulating a second lubricant for lubricating the shed forming device. The loom includes a heat exchanger system for exchanging heat between the first lubricant and the second lubricant without fluid communication between the lubricants.

10 Claims, 5 Drawing Sheets

LOOM AND A METHOD OF CONTROLLING THE TEMPERATURE OF A LUBRICANT IN SUCH A LOOM

BACKGROUND OF THE INVENTION

1. Field of the Invention

The invention relates to a loom in which use is made of a lubricant, such as oil, in particular within a shed-forming device of the dobby, cam mechanism, or Jacquard mechanism type.

2. Brief Description of the Related Art

Modern looms operate at high speeds, often faster than 900 picks per minute. The shed-forming devices associated with such looms need to develop a large amount of mechanical power, some of which is lost to friction, thereby producing heat. This heat production increases the temperature of the oil used within such a device for lubricating its moving parts. The oil heats up to a temperature such that a cover of such a shed-forming device can become too hot to touch, which is dangerous for an operator nearby. This heating also has the consequence of the oil reaching a temperature range in which its viscosity is significantly modified, to such an extent that it is no longer guaranteed that a film of oil between two contacting parts will have the necessary thickness.

It is known from JP-A-10 251943 to feed with oil several components of a loom, from a single tank. A water circuit is used to cool the content of this tank.

US-A-2003/0178089 discloses circulating the oil of a shed-forming device through an external plate heat exchanger of the water/oil type. That approach requires the use of a cold source external to the loom and requires water to be brought to the heat exchanger, thereby requiring pipes to be installed over a considerable length. Furthermore, that approach imposes mixing the oil used for lubricating the various portions of a loom in order to take the oil to the heat exchanger. Unfortunately, the oil that is best suited to lubricating the shed-forming device is not necessarily the same as the oil that is best suited to lubricating a beater box or means for controlling of a device for inserting picks in a loom. It is therefore necessary to accept a compromise concerning the type of oil that is to be used. Furthermore, in spite of settling devices being used, hard particles produced in the event of failure of one of the members of the loom or of the shed-forming device may then contaminate all of the other members and may significantly shorten the lifetime of the loom.

SUMMARY OF THE INVENTION

The invention seeks more particularly to remedy those drawbacks by proposing a novel loom that includes, amongst others, a shed-forming device that is lubricated under good conditions without spoiling the nature of the lubricant used to do this.

To this end, the invention provides a loom comprising: a subassembly including heddles, a beater, and means for inserting weft into the shed formed by warp yarns, and a shed-forming device. In this loom, lubrication means for lubricating certain components of the above-mentioned subassembly include a first circuit for circulating a first lubricant, and means for lubricating the shed-forming device and including a second circuit for circulating a second lubricant. In accordance with the invention, the loom includes a heat exchanger system for exchanging heat between the first lubricant and the second lubricant without fluid communication between these lubricants, and the heat exchanger system comprises means for circulating one of the lubricants selected from the first and second lubricants, or a coolant fluid to a zone where the lubricant or the coolant fluid is in thermal contact with another lubricant selected from the first and second lubricants.

By means of the invention, one of the lubricants, having an operating temperature that rises relatively little, is used to cool the other lubricant that has an operating temperature that rises further. In practice, the invention makes it possible to use the first lubricant that circulates through the components of the subassembly including, amongst others, the heddles, the beater, and the weft inserter means, in order to cool the second lubricant that flows through the shed-forming device. The temperature of the first lubricant is generally less than 70° C., since this lubricant comes into contact with relatively large heat exchange areas with air, whereas the temperature of the lubricant in the shed-forming device is higher because that equipment is compact.

According to aspects of the invention that are advantageous but not essential, a loom in accordance with the invention may incorporate one or more of the following features taken in any technically feasible combination:

- The means for putting the lubricant into circulation comprise at least one pump and associated lines for circulating one of the lubricants selected from the first lubricant and the second lubricant or the coolant fluid to the thermal contact zone or from said zone.
- The loom includes at least one temperature sensor for sensing the temperature of one of the lubricants or of a coolant fluid.
- The loom includes regulation means for regulating heat exchange between the first and second lubricants. The regulation means advantageously comprise means for controlling the pump as a function of the signal output by the temperature sensor.
- The heat exchanger means comprise a heat exchanger and means for bringing the first and second lubricants to the heat exchanger.
- The heat exchanger means comprise a third circuit in which a coolant fluid circulates between a first zone of thermal contact with the first circuit and a second zone of thermal contact with the second circuit.
- At least one of the coolant fluid circulation circuits includes a volume forming a supply of lubricant circulating in said circuit, and the heat exchanger means include means for bringing a coolant fluid or the lubricant of the other circuit into the supply-forming volume.
- The first lubricant is used for lubricating means for driving the beater, the weft inserter means, and/or a device for driving a beam or a roller for winding the cloth.

The invention also provides a method of controlling the temperature of a lubricant in a shed-forming device suitable for use in a loom, as mentioned above. The method consists in putting said lubricant into thermal contact with another lubricant used for lubricating certain components of a subassembly of the loom, which subassembly includes heddles, a beater, and means for inserting weft into the shed formed by warp yarns.

BRIEF DESCRIPTION OF THE DRAWINGS

The invention can be better understood and other advantages thereof appear more clearly in the light of the following description of five embodiments of looms in accordance with its principle, given purely as examples and with reference to the accompanying drawings, in which.

DESCRIPTION OF THE PREFERRED EMBODIMENTS

Figure 1:
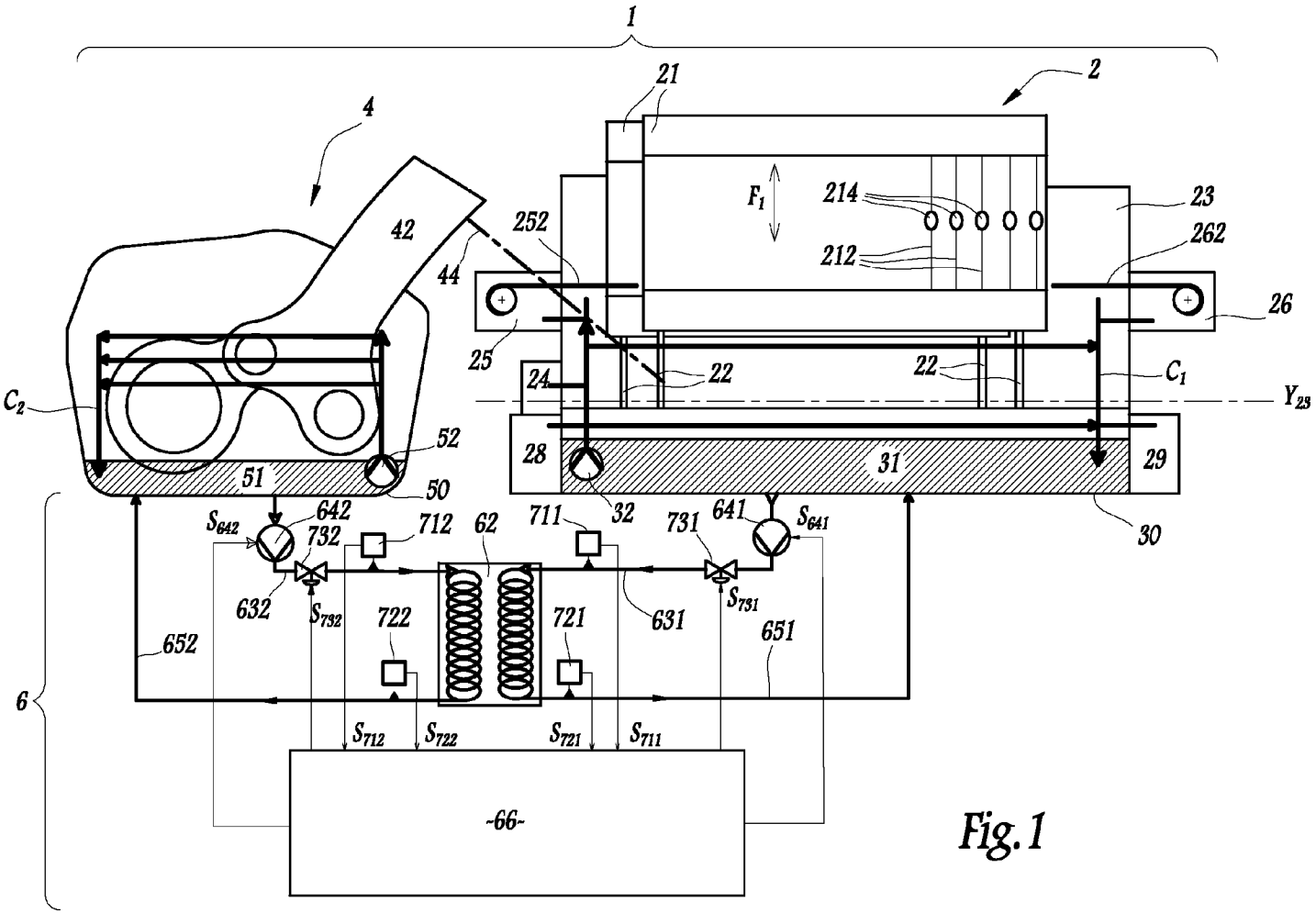
FIG. 1 is a diagram showing the principle of a loom in accordance with a first embodiment of the invention.
Figure 2:
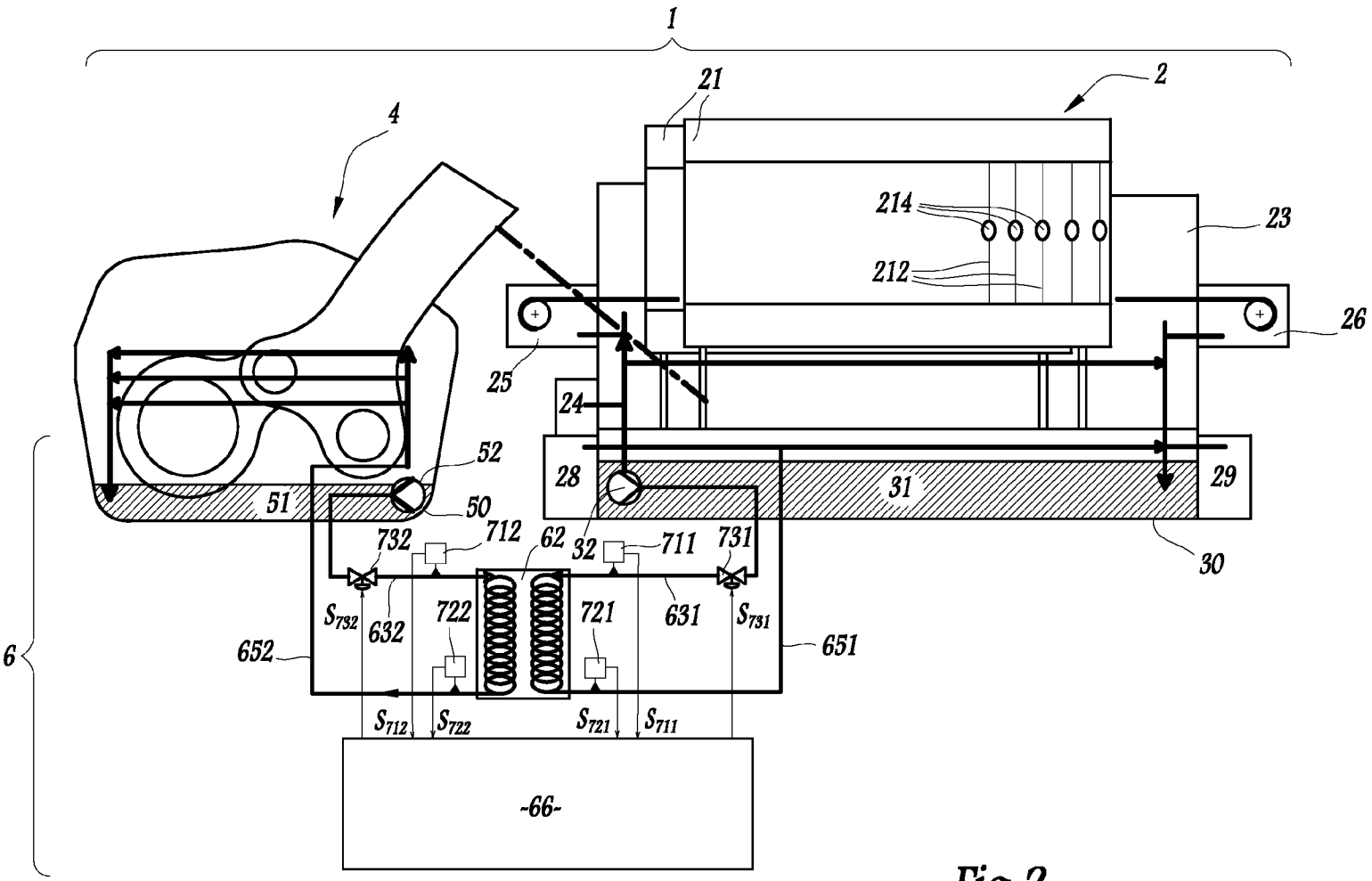
FIGS. 2 to 5 are diagrams analogous to FIG. 1 showing looms respectively in accordance with second, third, fourth, and fifth embodiments of the invention.
Figure 3:
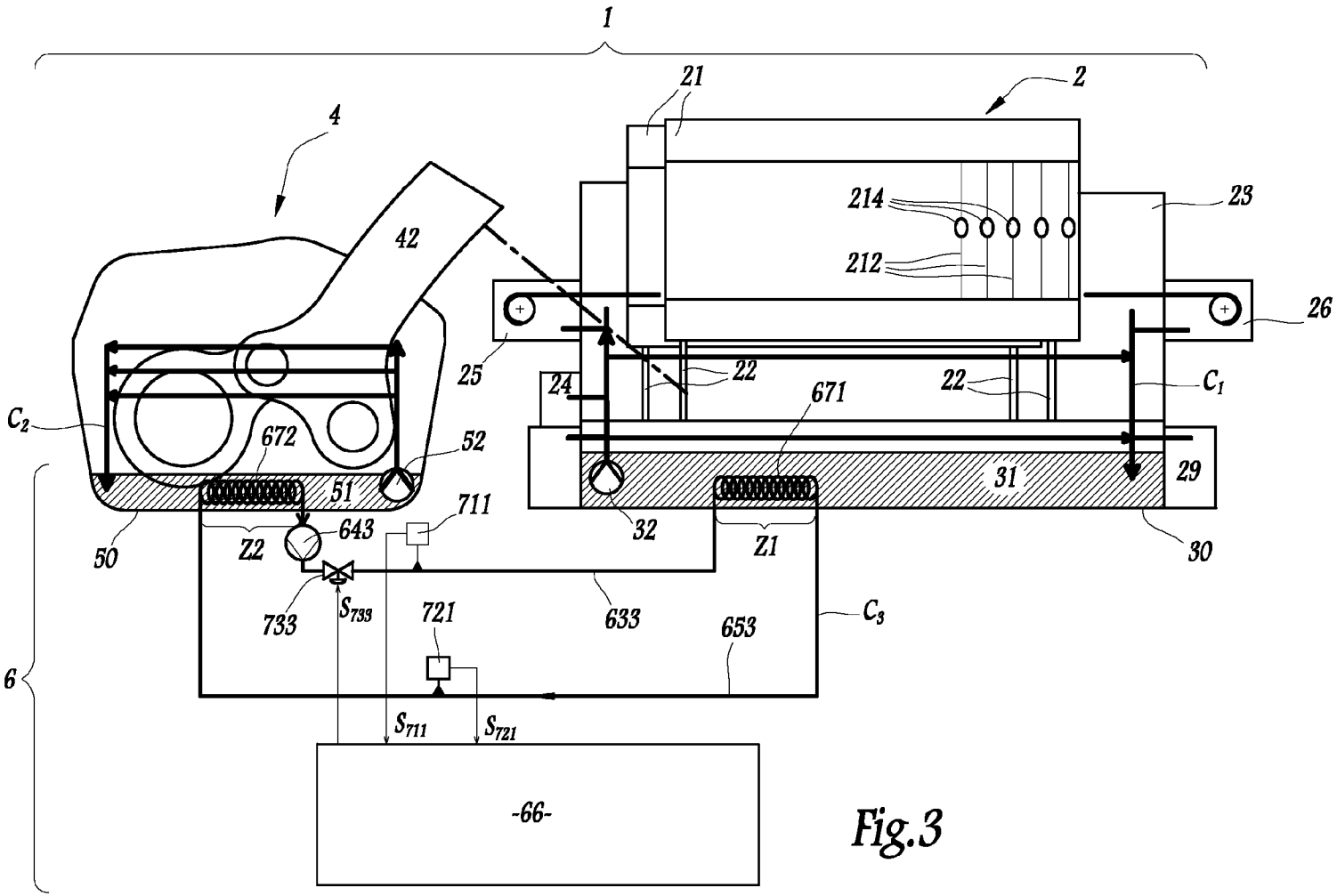

The loom 1 shown in FIG. 1 includes a subassembly 2 within which warp yarns and weft yarns (not shown) are woven. The subassembly 2 has a plurality of heddle frames 21, each fitted with a plurality of heddles 212, only some of which are shown in FIG. 1 for clarity in the drawing, each of which is provided with an eyelet 214 for passing a warp yarn. These heddle frames 21 are driven by pull rods 22, themselves controlled by reversing levers (not shown).

The subassembly 2 also includes a beater or comb 23 for striking the weft yarns after weaving in order to make the cloth compact. The beater is hinged about an axis $Y_{23}$ perpendicular to the direction in which the heddle frame 21 oscillates vertically, as represented by double-headed arrow $F_1$. A drive mechanism 24 moves the beater 23 to pivot back and forth about the axis $Y_{23}$.

The subassembly 2 also has weft inserter means 25 and 26 disposed on either side of the frames 21. These means 25 and 26 serve to control rapiers 252 and 262 that are used for inserting weft yarns into the shed formed by the warp yarns that pass through the eyelets 214.

The subassembly 2 also includes a beam from which the warp yarns are unwound on their way towards the eyelets 214 of the heddles 212, together with a roller onto which the cloth is wound progressively while it is being fabricated on the loom 1. The beam and the roller are not shown in FIG. 1. They are driven by respective mechanisms 28 and 29 provided for that purpose.

A circuit $C_1$ for circulating a first oil is provided inside the subassembly 2 in order to lubricate the mechanism 24, the weft inserter means 25 and 26, and the mechanisms 28 or 29. In a variant, the circuit $C_1$ may be used to lubricate only some of the pieces of equipment mentioned above, or other pieces of equipment forming part of the subassembly 2.

In FIG. 1, the circuit $C_1$ is represented very diagrammatically by means of arrows that do not necessarily correspond to the path followed by the circuit $C_1$ in the subassembly 2.

The circuit $C_1$ includes a pan 31 formed in the bottom portion of a casing 30 of the subassembly 2. A pump 32 is installed in the pan 31 and serves to circulate the oil via ducts (not shown in detail) within the circuit $C_1$, each leading to mechanisms for lubricating. The oil of the circuit $C_1$ also has a thermal function insofar as it serves to cool the parts of the subassembly 2 with which it comes into contact. This first oil thus performs a lubricating function and a cooling function, such as that provided by a coolant fluid.

The loom 1 also has a dobby 4 for driving the various heddle frames 21. To do this, the dobby 4 has as many oscillating levers 42 as there are pull rods 22 in the set, each lever 42 being dynamically connected to the rods 22 of a heddle frame 21 in known manner that is represented by a chain-dotted line 44 in FIG. 1.

A second lubrication circuit $C_2$ is provided inside the dobby 4. This circuit has a pan 51 formed in the bottom portion of a casing 50 of the dobby 4 and within which there is placed a pump 52 serving to circulate a second oil via ducts (not shown) within the circuit $C_2$ and leading to portions of the dobby 4 that need to be lubricated.

The circuit $C_2$ is also shown in highly diagrammatic manner. The oil of the circuit $C_2$ also has a thermal function, insofar as it serves to cool those parts of the dobby 4 with which it comes into contact. This second oil thus performs both a lubricating function and a cooling function, like that of a coolant fluid.

Given its compact nature and its speed of operation, the dobby 4 tends to heat up strongly, such that the second oil flowing in the circuit $C_2$ and present in the pan 51 reaches a high temperature, a temperature higher than that of the first oil.

In order to limit the heating of the oil present in the dobby 4, a heat exchanger system 6 is provided to enable the oil present in the circuit $C_2$ to be cooled by means of the oil present in the circuit $C_1$. In operation of the loom 1, the oil of the circuit $C_1$ heats up less than the oil of the circuit $C_2$ because the heat exchange areas of the circuit $C_1$ with the outside are larger. In practice, in a high-performance loom, the temperature of the oil in the circuit $C_1$ is of the order of 50° C. to 70° C., whereas the temperature of the oil in the circuit $C_2$ is of the order of 80° C. to 100° C., or even more. For this purpose, a heat exchanger 62 is installed between the subassembly 2 and the dobby 4.

The heat exchanger 62 is fed from the pan 31 by a line 631 having a pump 641 installed therein. A return line 651 returns oil from the heat exchanger 62 to the pan 31 of the circuit $C_1$.

Furthermore, a feed line 632 connects the pan 51 to the heat exchanger 62. A pump 642 is installed in this feed line, and a return line 652 connects the heat exchanger 62 to the pan 51.

Thus, the pumps 641 and 642 serve to convey respective quantities of oil to the heat exchanger 62. Insofar as the oil present in the pan 31 is at a temperature that is lower than the temperature of the oil present in the pan 51, this serves to lower the temperature of the oil in the circuit $C_2$.

A temperature probe 711 is placed at the inlet to the heat exchanger 62 on the line 631, and a temperature probe 721 is placed at the outlet from the heat exchanger 62 on the line 651. Similarly, two temperature probes 712 and 722 are placed at the inlet and the outlet of the heat exchanger 62, on the lines 632 and 652 respectively.

A valve 731 is installed in the line 631 between the pump 641 and the probe 711. Similarly, a valve 732 is installed in the line 632, between the pump 642 and the probe 712.

An electronic control unit 66 controls the operation of the pumps 641 and 642 by means of electric signals $S_{641}$ and $S_{642}$. The unit 66 also controls the operation of the vales 731 and 732 by means of dedicated electric signals $S_{721}$ and $S_{722}$. The output signals from the temperature probes 711, 712, 721, and 722 are delivered respectively to the unit 66 in the form of electric signals $S_{711}$, $S_{712}$, $S_{721}$, and $S_{722}$.

By construction, the oil circulation ducts of the subassembly 2 in the lines 631 and 651 and in the heat exchanger 62 are separated in leaktight manner from the oil circulation ducts of the dobby 4 in the lines 632 and 652 and in the heat exchanger 62. In other words, the exchange of heat between the oil of the subassembly 2 and the oil of the dobby 4 does not give rise to either of these oils becoming polluted with the other.

When the loom 1 is put into operation, with the oils then being cold, the valve 732 is controlled by the unit 66 so that the oil flow rate in the line 632 is relatively low. The oil in the circuit $C_2$ is cooled little and heats up quickly in order to reach a temperature threshold above which its fluidity enables it to penetrate into the smallest clearances and to eliminate any risk of sticking phenomena occurring inside the dobby 4.

Once this threshold temperature has been reached, the flow rate in the line 632 is raised progressively and then stabilized when a second threshold value is reached that is higher than the first threshold value.

The flow rate of oil from the circuit $C_2$ through the heat exchanger 62 may also be controlled by the signal $S_{642}$ that serves to control the speed of rotation of the pump 642.

In practice, as mentioned above, the oil of the circuit $C_2$ reaches a temperature of about 90° C. under steady conditions, whereas the temperature of the oil in the circuit $C_1$, in particular the temperature of the oil in the pan 31, is of the order of 60° C. Because of the heat exchanger system of the invention, the oil temperature in both circuits $C_1$ and $C_2$ is about 70° C.

By acting on the respective degrees of opening of the valves 731 and 732 or on the speeds of rotation of the pumps 641 and 642, it is possible to control the respective flow rates of oil in the circuit $C_1$ and of oil in the circuit $C_2$ in order to maintain a temperature difference between these oils. Maintaining such a temperature difference is nevertheless not compulsory.

The system 6 may operate without regulating the flow rate of oil in the circuit $C_1$ and of oil in the circuit $C_2$. Nevertheless, making use of some or all of the temperature probes 711, 712, 721, and 722 makes it possible to detect whenever a threshold value is exceeded that is potentially dangerous for the quality of the oils being used or for the equipment with which the oils come into contact, such as sealing gaskets. In the event of such a threshold value being exceeded, operation of the loom 1 may be stopped by the control unit 66, or an alarm may be triggered.

In the second to fifth embodiments shown in FIGS. 2 to 5, elements that are analogous to elements of the first embodiment are given the same references. Below, the description relates only to matters that distinguish each embodiment from the first embodiment. Unless mentioned to the contrary, the structure and the operation of the devices in FIGS. 2 to 5 are identical to those of the first embodiment.

In the second embodiment, no pumps are provided within the heat exchanger system 6 in the lines 631 and 632 feeding the heat exchanger 62 with oil from the circuits $C_1$ and $C_2$. The pumps 32 and 52 of the circuits $C_1$ and $C_2$ are used for this purpose insofar as they deliver directly into the feed lines 631 and 632, with the elements for lubricating being fed from the return lines 651 and 652. This embodiment is less expensive than the preceding embodiment since it enables the pumps 641 and 642 of the first embodiment to be omitted.

In the third embodiment, a coolant fluid circuit $C_3$ is installed between the pan 31 of the subassembly 2 and the pan 51 of the dobby 4. A heat exchange zone $Z_1$ is provided between the circuit $C_3$ and the content of the pan 31, within said pan, and a second heat exchange zone $Z_2$ is provided between the circuit $C_3$ and the content of the pan 51, within said pan. These heat exchange zones are made within the heat exchanger system 6 by means of coils 671 and 672 through which the coolant fluid flows, which coils are placed within the pans 31 and 51. The heat exchange zones $Z_1$ and $Z_2$ are leaktight.

The coolant fluid of the circuit $C_3$ may be of any known type and need not necessarily be an oil, since it does not perform any lubrication function.

A pump 643 is installed in one of the pipes 633 of the circuit $C_3$ connecting the zone $Z_1$ to the zone $Z_2$. This pump serves to cause the coolant fluid to circulate between the zone $Z_2$ and $Z_1$ and to return via a pipe 653.

A valve 733 serves to regulate the flow rate of coolant fluid in this circuit, and consequently to regulate the magnitude of the heat exchange between the oils belonging respectively to the circuit $C_1$ and to the circuit $C_2$. The valve 733 is controlled by an electronic control unit 66 via an electric signal $S_{733}$.

In a variant, the pump 643 may be controlled by the unit 66, as in the first embodiment.

In this embodiment, heat exchange between the oils of the circuits $C_1$ and $C_2$ is indirect, passing via the coolant fluid $C_3$.

This embodiment is particularly suitable for shed-forming devices and for loom subassemblies in which no pump is provided that is equivalent to the pumps 32 and 52 of the first and second embodiments.

In the fourth embodiment, a portion of the content of the pan 31 is pumped into a circuit $C_4$ that includes a leaktight heat exchange zone $Z_4$ constituted by a coil 674 placed in the pan 51 of the dobby 4. A pump 644 serves to circulate the oil of the circuit $C_1$ through the circuit $C_4$ that comprises a line 634 for feeding the coil 674 and a return line 654 going back to the pan 31. Under such circumstances, the relatively cold oil of the circuit $C_1$ is taken to the pan 51 of the circuit $C_2$ in order to cool the oil located therein.

Figure 4:
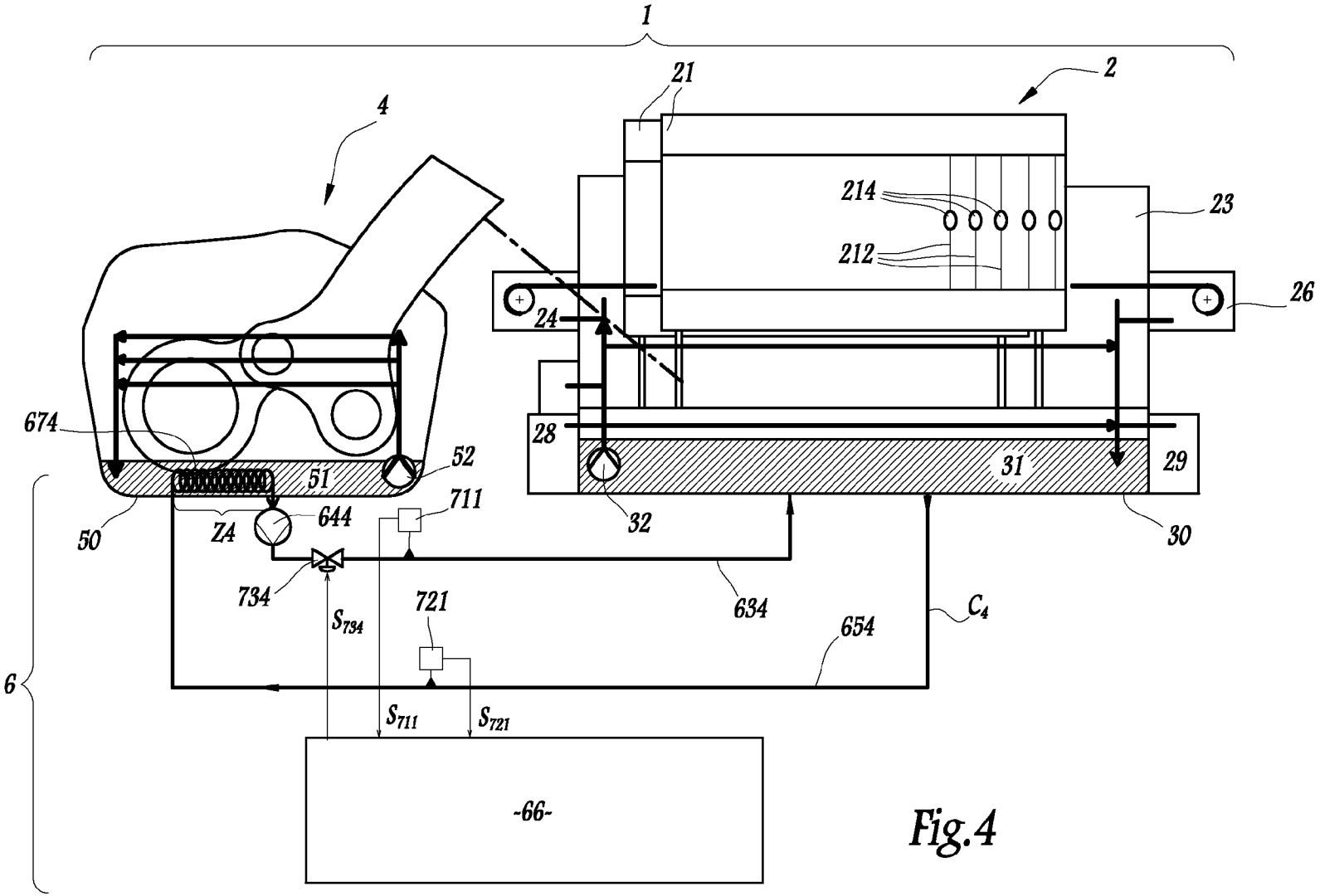

In the fifth embodiment, an approach is adopted that is the inverse of that of the embodiment of FIG. 4. In other words, the oil of the circuit $C_2$ is taken to the pan of the circuit $C_1$ within a leaktight heat exchange zone $Z_5$ formed by a coil 675 forming part of a circuit $C_5$ within which a pump 645 is located. Oil taken from the pan 51 flows along a line 635 for feeding the coil 675 and returns to the pan 51 via a return line 655.

Figure 5:
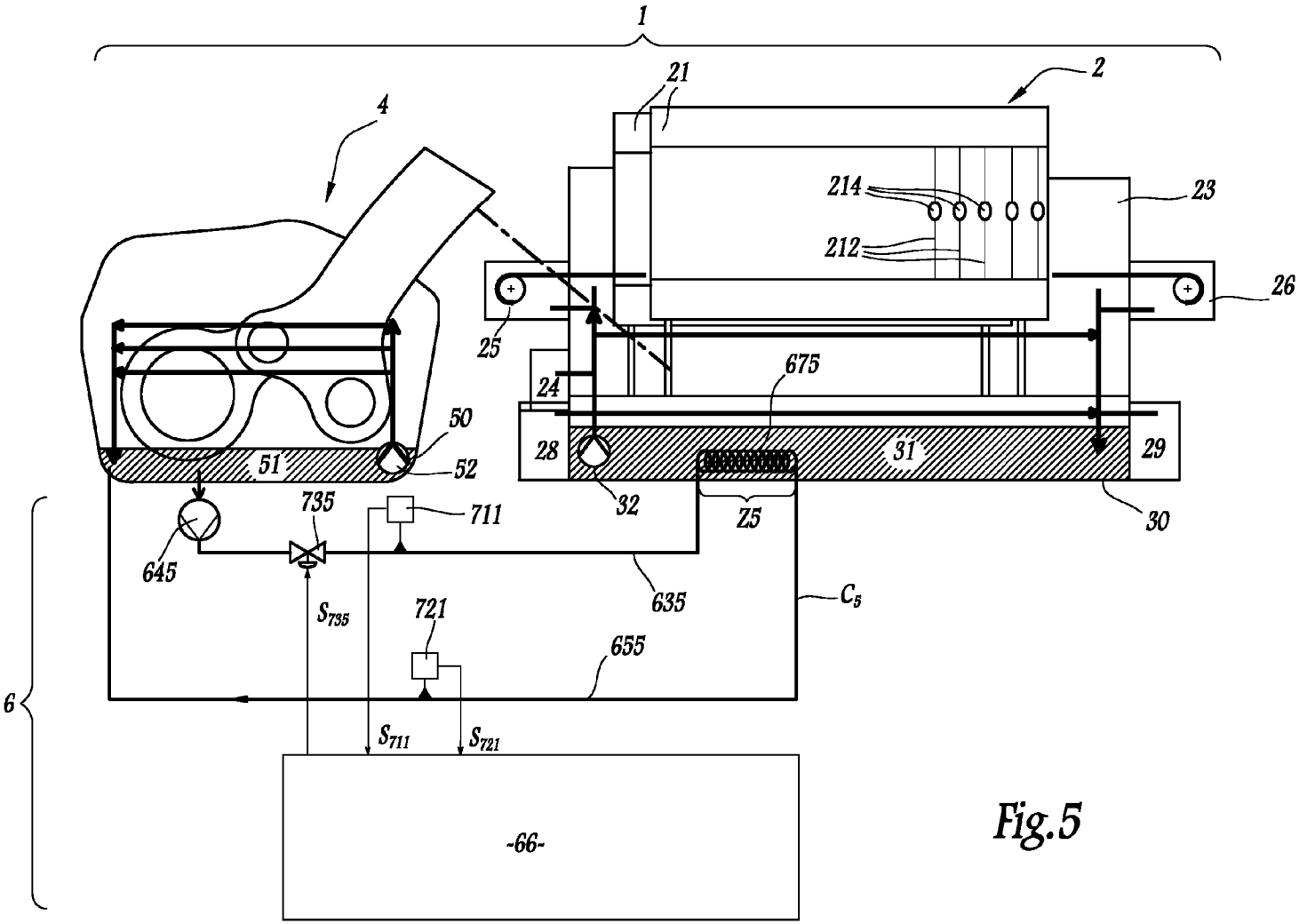

In the embodiments of FIGS. 4 and 5, valves 734 and 735 controlled by signals $S_{734}$ and $S_{735}$ delivered by an electronic control unit 66 serve to regulate the flow of oil in the circuits $C_4$ and $C_5$ and through the heat exchanger systems 6. The valves 734 and 735 may include branch connections leading to the lines 654 and 655.

In the embodiments of FIGS. 2 to 5, temperature sensors 711, 712, 721, and/or 722 are used, as in the first embodiment. Nevertheless, this is not compulsory.

Whatever the embodiment, heat exchange between the oil of the circuit $C_1$ and the oil of the circuit $C_2$ enables the temperature of the oil of the shed-forming device to be lowered, and this is advantageous in terms of the lubrication and in terms of the lifetime of this equipment. Insofar as the two circuits $C_1$ and $C_2$ remain separated from each other, given that the heat exchanger zone is leaktight, it is possible to use different oils in these two circuits.

The invention is described above for a shed-forming device constituted by a dobby. The dobby may be of the positive type or of the negative type. It is also possible for the shed-forming device to be a basic weave mechanism or a Jacquard machine if the loom is a Jacquard loom.

The loom may be a single-layer loom or a two-layer loom and it may be used for weaving any type of cloth.

The invention applies to looms having rapiers as shown in the figures, and also to looms using projectiles, air, or water.

In the embodiments described and shown in the figures there are pumps for circulating oil in the circuits $C_1$ and $C_2$. Nevertheless, the invention can be used with oil-bath circuits in which it is the movement of the parts in the subassembly 2 and/or in the shed-forming device 4 that suffices to lubricate the joints by spraying.

Under such circumstances, the circuits $C_1$ and/or $C_2$ are formed by zones in which oil circulates in the equipment 2 and/or 4.

The technical characteristics of the embodiments and variants described above may be combined with one another.

The invention claimed is:

1. A loom comprising:

a subassembly including heddles, a beater, and inserter means for inserting weft into the shed formed by warp yarns;

a shed-forming device;

first lubrication means for lubricating certain components of the subassembly, the first lubrication means including a first circuit for circulating a first lubricant; and second lubrication means for lubricating the shed-forming device, the second lubrication means including a second circuit for circulating a second lubricant;

a heat exchanger system for exchanging heat between the first lubricant and the second lubricant without fluid communication between one another, and wherein the heat exchanger system includes circulation means for circulating a lubricant selected from the first and second lubricants and a coolant fluid to a heat exchange zone where the lubricant or the coolant fluid is in heat exchange relationship with another lubricant selected from the first and second lubricants such that the first lubricant is used as a heat exchange agent for the second lubricant.

2. The loom according to claim 1, wherein the circulation means includes at least one pump and associated lines for circulating at least one of the lubricants selected from the first and second lubricants or the coolant fluid to and from the heat exchange zone.

3. The loom according to claim 1, including at least one temperature sensor for sensing a temperature of one of the first and second lubricants or the coolant fluid.

4. The loom according to claim 1, including regulation means for regulating heat exchange between the first and second lubricants.

5. The loom according to claim 4, wherein the circulation means includes at least one pump and associated lines for circulating at least one of the lubricants selected from the first and second lubricants or the coolant fluid to or from the heat exchange zone, and at least one temperature sensor for sensing a temperature of one of the first and second lubricants or of the coolant fluid and the regulation means includes means for controlling the at least one pump as a function of a signal output from the at least one temperature sensor.

6. The loom according to claim 1, wherein the heat exchange zone of the heat exchanger system includes a heat exchanger and the circulation means conveys the first and second lubricants to and from the heat exchanger.

7. The loom according to claim 1, wherein the heat exchanger system includes a third circuit in which the coolant fluid circulates between a first heat exchange zone of thermal contact with the first circuit and a second heat exchange zone of thermal contact with the second circuit.

8. The loom according to claim 1, wherein at least one of the first and second circuits includes a volume forming a supply of lubricant circulating in the at least one circuit, and wherein the heat exchanger system includes means for bringing the coolant fluid or the lubricant of the other of the first and second circuits into the supply forming volume.

9. The loom according to claim 1, wherein the first lubricant is used for lubricating at least one of driving means for driving the beater, the inserter means for inserting the weft, and a device for driving a beam or a roller for winding cloth.

10. A method of controlling temperature of a lubricant in a shed-forming device of a loom, wherein the method includes the steps of putting the lubricant into leaktight heat exchange relationship with another lubricant used for lubricating components of a subassembly of the loom including heddles, a beater, and inserting means for inserting weft into a shed formed by warp yarns such that one of the lubricants functions to cool the other lubricant.

* * * * *